US006085374A

United States Patent [19]

Richey

[11] Patent Number: 6,085,374

[45] Date of Patent: Jul. 11, 2000

[54] WIRE TIE REMOVAL TOOL

[76] Inventor: Joe E. Richey, 150 Indiana St., Gridley, Calif. 95948-2912

[21] Appl. No.: 09/168,466

[22] Filed: Oct. 8, 1998

[51] Int. Cl.[7] ..... B26B 11/00

[52] U.S. Cl. ..... 7/118; 87/488; 140/123

[58] Field of Search ..... 7/118; 81/488; 140/123

[56] References Cited

U.S. PATENT DOCUMENTS

| | | | |
|---|---|---|---|
| 3,584,525 | 6/1971 | Caveney | 81/488 |
| 4,187,607 | 2/1980 | Simuro et al. | 7/118 |
| 4,335,477 | 6/1982 | Halstead | 81/488 X |
| 4,459,717 | 7/1984 | Halstead | 7/134 |
| 5,806,119 | 9/1998 | Wood | 7/118 |

*Primary Examiner*—James G. Smith

[57] ABSTRACT

A wire tie removal tool is provided including a blade with a pair of planar faces and a periphery defined by a pair of elongated side edges and a pair of short edge edges. One of the faces of the blade is tapered at one of the end edges thereof to define a minimal thickness at the end edge.

5 Claims, 2 Drawing Sheets

WIRE TIE REMOVAL TOOL

BACKGROUND OF THE INVENTION

1. Field of the Invention

The present invention relates to wire ties and more particularly pertains to a new wire tie removal tool for conveniently removing wire ties for reuse.

2. Description of the Prior Art

The use of wire ties is known in the prior art. More specifically, wire ties heretofore devised and utilized are known to consist basically of familiar, expected and obvious structural configurations, notwithstanding the myriad of designs encompassed by the crowded prior art which have been developed for the fulfillment of countless objectives and requirements.

Known prior art wire ties and related tools include U.S. Pat. No. 4,459,717; U.S. Pat. No. 3,584,525; U.S. Pat. No. 4,335,477; U.S. Pat. No. 3,406,412; U.S. Pat. No. 3,232,450; and U.S. Pat. No. Des. 355,103.

In these respects, the wire tie removal tool according to the present invention substantially departs from the conventional concepts and designs of the prior art, and in so doing provides an apparatus primarily developed for the purpose of conveniently removing wire ties for reuse.

SUMMARY OF THE INVENTION

In view of the foregoing disadvantages inherent in the known types of wire ties now present in the prior art, the present invention provides a new wire tie removal tool construction wherein the same can be utilized for conveniently removing wire ties for reuse.

The general purpose of the present invention, which will be described subsequently in greater detail, is to provide a new wire tie removal tool apparatus and method which has many of the advantages of the wire ties mentioned heretofore and many novel features that result in a new wire tie removal tool which is not anticipated, rendered obvious, suggested, or even implied by any of the prior art wire ties, either alone or in any combination thereof.

To attain this, the present invention generally comprises a handle having a top face, a bottom face, and a pair of side faces each with a planar rectangular configuration. As shown in the Figure, the handle further includes a pair of arcuate end faces and a rectangular recess formed in the top face. As shown in FIG. 1, such recess extends to one of the end faces. A pivot post is mounted between the side faces of the handle at an end of the recess. For reasons that will become apparent hereinafter, a pair of beveled slots are formed in one of the side faces adjacent to ends of the recess of the handle. Next provided is a plurality of blades each having a common length, a unique width and a unique thickness. An inboard end of each blade is equipped with a closed loop configuration pivotally coupled to the pivot post. By this structure, the blades are each adapted for being transferred between an employed orientation extending from the handle in collinear relationship therewith. The blades may also be maintained in a stored orientation situated within the recess. Each of the blades further includes an outboard end with a first side of the blade being planar and a second side tapering to define an edge. A planar rectangular tab is integrally coupled to a side edge of the blade adjacent to and spaced from the outboard end of the blade. This tab extends laterally from the blade in coplanar relationship therewith, as shown in FIG. 1. Also included is a hook having a length greater than that of the blades. Similar to the blades, the hook has an inboard end with a closed loop configuration pivotally coupled to the pivot post. As shown in FIG. 1, the hook is pivotally coupled between the blades and one of the side faces of the handle on which the slots are formed. The hook is defined by a short beveled inboard portion, an elongated linear intermediate portion which remains in parallel with the handle, and a short beveled outboard portion. An outboard end of the hook is equipped with a lip which extends inwardly in perpendicular relationship with the handle. In use, the hook is adapted for being transferred between an employed orientation and a stored orientation. In the stored orientation, the ends of the hook are situated within the recess of the handle. Further, the intermediate portion resides exterior of the recess of the handle while the beveled portions extends through the slots of the handle. Note FIG. 1.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wire tie removal tool apparatus and method which has many of the advantages of the wire ties mentioned heretofore and many novel features that result in a new wire tie removal tool which is not anticipated, rendered obvious, suggested, or even implied by any of the prior art wire ties, either alone or in any combination thereof.

It is another object of the present invention to provide a new wire tie removal tool which may be easily and efficiently manufactured and marketed.

It is a further object of the present invention to provide a new wire tie removal tool which is of a durable and reliable construction.

An even further object of the present invention is to provide a new wire tie removal tool which is susceptible of a low cost of manufacture with regard to both materials and labor, and which accordingly is then susceptible of low prices of sale to the consuming public, thereby making such wire tie removal tool economically available to the buying public.

Still yet another object of the present invention is to provide a new wire tie removal tool which provides in the apparatuses and methods of the prior art some of the advantages thereof, while simultaneously overcoming some of the disadvantages normally associated therewith.

Still another object of the present invention is to provide a new wire tie removal tool for conveniently removing wire ties for reuse.

Even still another object of the present invention is to provide a new wire tie removal tool that includes a blade with a pair of planar faces and a periphery defined by a pair of elongated side edges and a pair of short edge edges. One of the faces of the blade is tapered at one of the end edges thereof to define a minimal thickness at the end edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
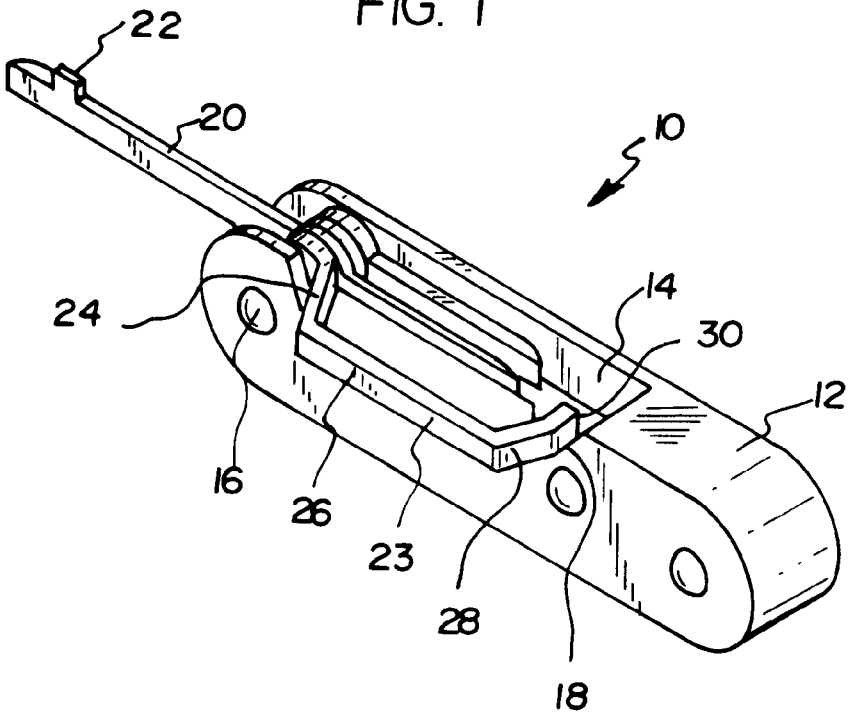
FIG. 1 is a perspective view of a new wire tie removal tool according to the present invention.
Figure 2:
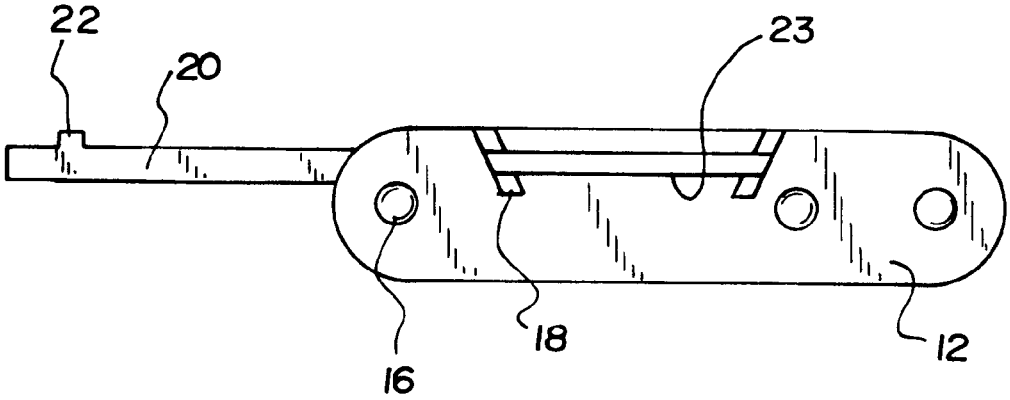
FIG. 2 is a side view of the present invention.
Figure 3:
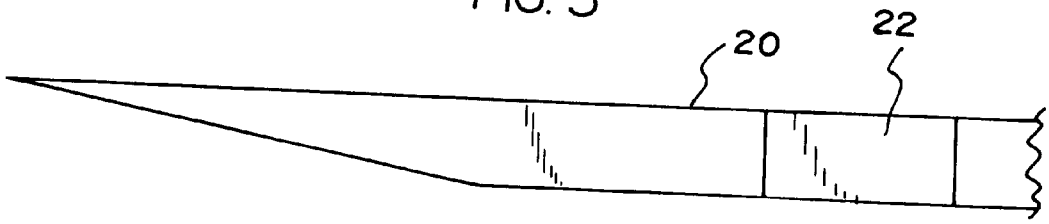
FIG. 3 is a detailed view of the outboard end of one of the blades of the present invention.
Figure 4:
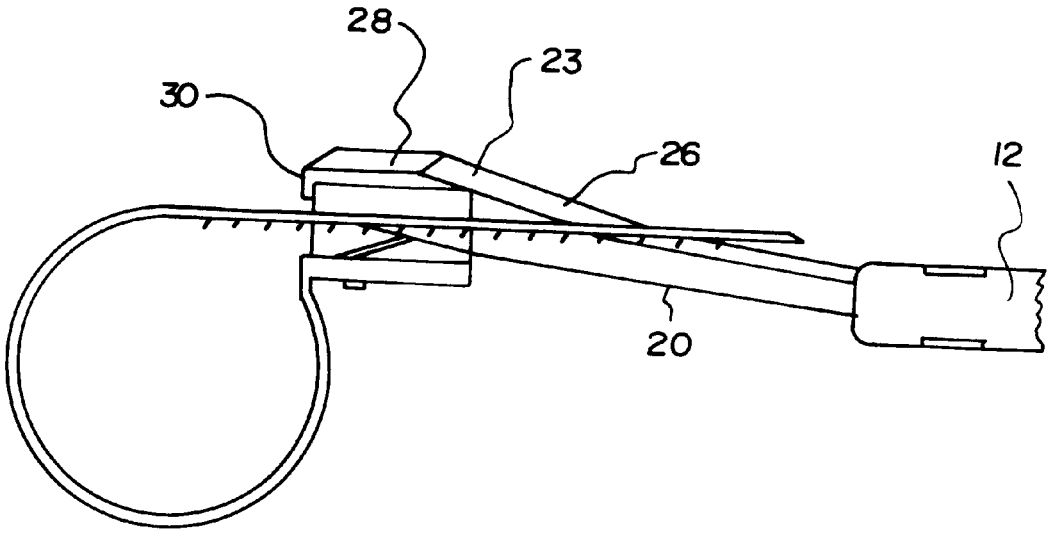
FIG. 4 is a perspective view of the present invention during use.

With reference now to the drawings, and in particular to FIGS. 1 through 4 thereof, a new wire tie removal tool embodying the principles and concepts of the present invention and generally designated by the reference numeral 10 will be described.

The present invention, designated as numeral 10, includes a handle 12 having a top face, a bottom face, and a pair of side faces each with a planar rectangular configuration. As shown in the Figure, the handle further includes a pair of arcuate end faces and a rectangular recess 14 formed in the top face. As shown in FIG. 1, such recess extends to one of the end faces. A pivot post 16 is mounted between the side faces of the handle at an end of the recess. For reasons that will become apparent hereinafter, a pair of beveled slots 18 are formed in one of the side faces adjacent to ends of the recess of the handle.

Next provided is a plurality of blades 20 each having a common length, a unique width and a unique thickness. An inboard end of each blade is equipped with a closed loop configuration pivotally coupled to the pivot post. By this structure, the blades are each adapted for being transferred between an employed orientation extending from the handle in collinear relationship therewith. The blades may also be maintained in a stored orientation situated within the recess.

Each of the blades further includes an outboard end whereat a first side of the blade is in coplanar relationship with the remaining portion of the blade and a second side angles inwardly toward the first side to define an end portion with a triangular cross-section with an edge. A planar rectangular tab 22 is integrally coupled to a side edge of the blade adjacent to and spaced from the tapering portion of the outboard end of the blade. This tab extends laterally from the blade in coplanar relationship therewith, as shown in FIG. 1.

Also included is a hook 23 having a length greater than that of the blades. Similar to the blades, the hook has an inboard end with a closed loop configuration pivotally coupled to the pivot post. As shown in FIG. 1, the hook is pivotally coupled between the second sides of the blades and one of the side faces of the handle on which the slots are formed. The hook is defined by a short beveled inboard portion 24, an elongated linear intermediate portion 26 which remains in parallel with the handle, and a short beveled outboard portion 28. An outboard end of the hook is equipped with a lip 30 which extends inwardly in perpendicular relationship with the handle. In use, the hook is adapted for being transferred between an employed orientation and a stored orientation. In the stored orientation, the ends of the hook are situated within the recess of the handle. Further, the intermediate portion resides exterior of the recess of the handle while the beveled portions extends through the slots of the handle. Note FIG. 1.

The method associated with the use of the present invention as set forth hereinabove will now be given. The present invention is adapted for being used with a wire tie including a strip with a plurality of teeth formed therein and a square loop mounted on an end thereof. Inside the loop is a pawl for engaging the teeth. In use, one of the blades which has a proper size and the hook of the present invention are deployed. The outboard end of the blade is inserted within the loop of the wire tie until the tab abuts the loop and the pawl is disengaged from the teeth. It should be noted that the tab serves to prevent damage to the teeth of the tie by precluding the blade from extending further into the loop than is necessary to disengage the pawl. Furthermore, the lip of the hook is positioned on an opposite side of the loop of the wire tie in order to maintain the present invention in place. By this procedure, the wire tie may be removed and reused a number of times.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wire tie removal tool comprising, in combination:

a handle including a top face, a bottom face, and a pair of side faces each with a planar rectangular configuration, the handle further including a pair of arcuate end faces, a rectangular recess formed in the top face and extending to one of the end faces, a pivot post mounted between the side faces of the handle at an end of the recess, and a pair of beveled slots formed in one of the side faces adjacent to ends of the recess of the handle;

a plurality of blades each having a common length, a unique width and thickness, an inboard end with a closed loop configuration pivotally coupled to the pivot post for being transferred between an employed orientation extending from the handle in collinear relationship therewith and a stored orientation situated within the recess, an outboard end with a first side of the blade being planar and a second side being angled toward the first side to define an edge at the outboard end, and a planar rectangular tab integrally coupled to a side edge of the blade adjacent to and spaced from the outboard end of the blade and extending laterally therefrom in coplanar relationship therewith; and a hook having a length greater than that of the blades, an inboard end with a closed loop configuration pivotally coupled to the pivot post between the blades and one of the side faces of the handle on which the slots are formed, a short beveled inboard portion, an elongated linear intermediate portion which remains in parallel with the handle, a short beveled outboard portion, and an outboard end with a lip extending inwardly in perpendicular relationship with the handle, wherein the hook is adapted for being transferred between an employed orientation and a stored orientation with the ends situated within the recess of the handle, the intermediate portion residing exterior of the recess of the handle and the beveled portions extending through the slots of the handle.

2. A wire tie removal tool comprising:

an elongate handle having a recess formed in a top face of the handle, and a pair of slots formed in a side face of the handle adjacent to ends of the recess;

a blade pivotally coupled to the handle for being moved between an extended orientation extending from the handle in a substantially collinear relationship with the elongate handle, and a stored orientation with the blade situated in the recess of the handle, the blade having an outboard end with a first side of the blade being substantially planar and a second side being angled toward the first side to define an edge at the outboard end, and a tab integrally coupled to a side edge of the blade adjacent to and spaced from the outboard end of the blade, the tab extending laterally from the side edge in coplanar relationship with the first and second sides; and a hook having an inboard end pivotally coupled to the handle, the hook having an inboard portion oriented at an angle to the handle, an elongated linear intermediate portion oriented substantially parallel to the handle, and an outboard portion oriented at an angle to the handle, an outboard end having a lip extending inwardly in a substantially perpendicular orientation with respect to the handle, wherein the hook is adapted for being moved between an employed orientation and a stored orientation characterized by the ends of the hook being positioned in the recess of the handle, the intermediate portion being positioned exterior of the recess of the handle with the inboard portion of the hook extending through one of the slots in the handle and the outboard portion extending through the other of the slots in the handle.

3. The wire tie removal tool as set forth in claim 2 wherein a plurality of blades are pivotally mounted on the handle with each blade having a common length and a unique width.

4. The wire tie removal tool as set forth in claim 2 wherein a plurality of blades are pivotally mounted on the handle with each blade having, a common length and a unique thickness.

5. A wire tie removal tool comprising:

a handle including a top face, a bottom face, and a pair of side faces, the handle further including a pair of end faces, a recess formed in the top face and extending toward one of the end faces, a pivot post mounted between the side faces of the handle at an end of the recess, and a pair of slots formed in one of the side faces adjacent to ends of the recess of the handle;

a blade having a length, a width and a thickness, an inboard end of the blade having a closed loop configuration pivotally coupled to the pivot post for being moved between an extended orientation extending from the handle in a substantially collinear relationship therewith, and a stored orientation with the blade situated in the recess, the blade having an outboard end with a first side of the blade being substantially planar and a second side being angled toward the first side to define an edge at the outboard end, and a tab integrally coupled to a side edge of the blade adjacent to and spaced from the outboard end of the blade, the tab extending laterally from the side edge in coplanar relationship with the first and second sides; and a hook, an inboard end of the hook having a closed loop configuration pivotally coupled to the pivot post between the side faces of the handle, the hook having an inboard portion, an elongated linear intermediate portion which extends substantially parallel to the handle, an outboard portion, and an outboard end with a lip extending inwardly in a substantially perpendicular orientation to the handle, wherein the hook is adapted for being moved between an employed orientation and a stored orientation characterized by the ends of the hook being situated in the recess of the handle, the intermediate portion being positioned exterior of the recess of the handle with the inboard portion of the hook extending through one of the slots in the handle and the outboard portion extending through the other of the slots in the handle.

* * * * *